US010995746B2

(12) United States Patent
Freund

(10) Patent No.: US 10,995,746 B2
(45) Date of Patent: May 4, 2021

(54) TWO-STAGE RECIPROCATING COMPRESSOR OPTIMIZATION CONTROL SYSTEM

(71) Applicant: AI ALPINE US BIDCO INC, Wilmington, DE (US)

(72) Inventor: Sebastian Walter Freund, Garching b. Muenchen (DE)

(73) Assignee: INNIO Jenbacher GmbH & Co OG, Jenbach (AU)

( * ) Notice: Subject to any disclaimer, the term of this patent is extended or adjusted under 35 U.S.C. 154(b) by 411 days.

(21) Appl. No.: 15/397,289

(22) Filed: Jan. 17, 2017

(65) Prior Publication Data

US 2018/0202431 A1 Jul. 19, 2018

(51) Int. Cl.

| | |
|---|---|
| ***F04B 49/02*** | (2006.01) |
| ***F04B 49/06*** | (2006.01) |
| ***F04B 49/20*** | (2006.01) |
| ***F04B 51/00*** | (2006.01) |
| ***F04B 49/16*** | (2006.01) |
| ***F04B 25/00*** | (2006.01) |

(52) U.S. Cl.

CPC ..... *F04B 49/02* (2013.01); *F04B 25/00* (2013.01); *F04B 49/065* (2013.01); *F04B 49/16* (2013.01); *F04B 49/20* (2013.01); *F04B 51/00* (2013.01); *F04B 2201/12* (2013.01); *F04B 2201/1201* (2013.01); *F04B 2205/00* (2013.01); *F04B 2205/09* (2013.01); *F04B 2207/01* (2013.01)

(58) Field of Classification Search

CPC ..... F04B 49/02; F04B 49/16; F04B 49/20; F04B 2205/09; F04B 2201/1201; F04B 25/00

See application file for complete search history.

(56) References Cited

U.S. PATENT DOCUMENTS 4,255,089 A * 3/1981 Phillips, Jr. ..... F04D 27/00 417/17
4,330,237 A * 5/1982 Battah ..... F04B 35/002 417/2

(Continued)

OTHER PUBLICATIONS

Extended European Search Report and Opinion issued in connection with corresponding EP Application No. 17205760.6 dated Mar. 14, 2018.

(Continued)

*Primary Examiner* — Christopher S Bobish
(74) *Attorney, Agent, or Firm* — Fletcher Yoder, P.C.

(57) ABSTRACT

According to some embodiments, system and methods are provided, comprising providing a dual-mode model for a reciprocating compressor, wherein the model includes a measurement mode and a tuning mode; receiving one or more inputs to the model from an operating reciprocating compressor; and in response to receipt of the one or more inputs, executing the model in at least one of the measurement mode and the tuning mode, wherein: in a measurement mode, execution of the model further comprises calculating an actual flow rate of gas in the compressor based on the one or more inputs; and in a tuning mode, execution of the model further comprises calculating one of an unloader setting and a speed set point of a physical element of the compressor for a given flow rate of gas. Numerous other aspects are provided.

14 Claims, 9 Drawing Sheets

(56) References Cited

U.S. PATENT DOCUMENTS 4,382,749 A * 5/1983 Teegarden ..... F04B 39/1033 417/295
4,447,193 A * 5/1984 Bunn ..... F04B 49/225 417/441
4,526,513 A * 7/1985 Bogel ..... F04B 49/02 417/18
4,825,380 A 4/1989 Hobbs
5,695,325 A * 12/1997 Sperry ..... F04B 49/02 417/443
6,238,188 B1 * 5/2001 Lifson ..... F04C 28/08 417/19
6,292,757 B1 9/2001 Flanagan et al.
6,361,288 B1 3/2002 Sperry
6,607,366 B2 * 8/2003 Sperry ..... F04B 39/1013 137/522
6,616,414 B2 * 9/2003 Yoo ..... F04B 35/045 417/44.1
6,881,040 B2 * 4/2005 Hattori ..... F04C 28/12 417/282
7,399,165 B2 * 7/2008 Horiuchi ..... F04B 49/002 417/287
7,403,850 B1 7/2008 Boutin et al.
7,785,078 B2 8/2010 Calamai
8,070,461 B2 * 12/2011 Sanford ..... F04B 39/08 417/306
8,147,211 B2 4/2012 Grant et al.
8,510,015 B2 * 8/2013 Beausoleil ..... G06K 7/10009 417/437
8,978,484 B2 * 3/2015 Tsuji ..... G01L 5/00 73/862.191
9,127,659 B2 * 9/2015 Kitchener ..... B29C 49/42
9,133,851 B2 * 9/2015 Ebisawa ..... F04D 27/0223
9,181,953 B2 * 11/2015 Steger ..... F04D 15/0066
9,416,790 B2 8/2016 Brenne et al.
10,087,944 B2 * 10/2018 Huberland ..... F04D 17/12
2009/0053072 A1 * 2/2009 Borgstadt ..... F04B 15/02 417/17
2016/0153442 A1 6/2016 Lim et al.
2016/0177937 A1 6/2016 Liu et al.

OTHER PUBLICATIONS

Jarvisalo et al., "Soft-Sensor-Based Flow Rate and Specific Energy Estimation of Industrial Variable-Speed-Driven Twin Rotary Screw Compressor", IEEE Transactions on Industrial Electronics, vol. 63, Issue:5, pp. 3282-3289, May 2016, Delhi.

* cited by examiner

TWO-STAGE RECIPROCATING COMPRESSOR OPTIMIZATION CONTROL SYSTEM

BACKGROUND

Industrial equipment or assets, generally, are engineered to perform particular tasks as part of a business process. For example, industrial assets can include, among other things and without limitation, manufacturing equipment on a production line, wind turbines that generate electricity on a wind farm, power plant or aircraft turbines, healthcare or imaging devices, or drilling equipment for use in mining operations. The design and implementation of these assets often takes into account both the physics of the task at hand, as well as the environment in which such assets are configured to operate.

Low-level software and hardware-based controllers have long been used to drive industrial assets. However, the rise of inexpensive cloud computing, increasing sensor capabilities, and decreasing sensor costs, as well as the proliferation of mobile technologies have created opportunities for creating novel industrial assets with improved sensing technology that are capable of transmitting data that can then be transmitted to a network. As a consequence, there are new opportunities to enhance the business value of some industrial assets using novel industrial-focused hardware and software.

A reciprocating compressor used to deliver gases at high pressure is an example of industrial equipment. Conventionally, compressor control and diagnostic systems rely on a lot of additional hardware and sensors to monitor and operate the compressor and are costly. Operators typically face hurdles with respect to operating the compressor and diagnostic systems associated with compressors.

It would be desirable to provide systems and methods to improve reciprocating compressor control systems in a way that provides optimized compressor and engine operation.

BRIEF DESCRIPTION

According to some embodiments, a method includes providing a dual-mode model for a reciprocating compressor, wherein the model includes a measurement mode and a tuning mode; receiving one or more inputs to the model from an operating reciprocating compressor; and in response to receipt of the one or more inputs, executing the model in at least one of the measurement mode and the tuning mode, wherein: in a measurement mode, execution of the model further comprises calculating an actual flow rate of gas in the compressor based on the one or more inputs; and in a tuning mode, execution of the model further comprises calculating one of an unloader setting and a speed set point of a physical element of the compressor for a given flow rate of gas.

According to some embodiments, a system includes one or more sensors to sense values of one or more parameters of an operating reciprocating compressor; a compressor module including a dual-model model, wherein the model includes a measurement mode and a tuning mode; a memory in communication with the one or more sensors and storing program instructions, the compressor module operative with the program instructions and data from the one or more sensors to perform the functions as follows: receive one or more inputs to the model from the one or more sensors associated with the operating reciprocating compressor; and in response to receipt of the one or more measured inputs, execute the model in at least one of the measurement mode and the tuning mode, wherein: in a measurement mode, execution of the model further comprises calculating an actual flow rate of gas in the compressor based on the one or more inputs; and in a tuning mode, execution of the model further comprises calculating one of an unloader setting and a speed set point of a physical element of the compressor for a given flow rate of gas.

According to some embodiments, a non-transitory, computer-readable medium stores instructions that, when executed by a computer processor, cause the computer processor to perform a method comprising: providing a dual-mode model for a reciprocating compressor, wherein the model includes a measurement mode and a tuning mode; receiving one or more inputs to the model from an operating reciprocating compressor; and in response to receipt of the one or more inputs, executing the model in at least one of the measurement mode and the tuning mode, wherein: in a measurement mode, execution of the model further comprises calculating an actual flow rate of gas in the compressor based on the one or more inputs; and in a tuning mode, execution of the model further comprises calculating one of an unloader setting and a speed set point of a physical element of the compressor for a given flow rate of gas.

A technical effect of some embodiments of the invention is an improved and/or computerized technique and system for controlling a flow rate and optimizing compressor and engine operation. Embodiments provide for increased productivity and lower operating costs for compressor stations. With this and other advantages and features that will become hereinafter apparent, a more complete understanding of the nature of the invention can be obtained by referring to the following detailed description and to the drawings appended hereto.

Other embodiments are associated with systems and/or computer-readable medium storing instructions to perform any of the methods described herein.

DRAWINGS

DETAILED DESCRIPTION

A reciprocating compressor used to deliver gases at high pressure is an example of industrial equipment. Conventionally, compressor control and diagnostic systems rely on a lot of additional hardware and sensors to monitor and operate the compressor and are costly. Operators typically face two hurdles with respect to the actual flow rate of gas they deliver: 1. The flow rate is typically not measured through flow meters at individual compressors or cylinders and may be unknown at the total level in real-time; and 2. Adjusting flow rate to a desired value and optimizing engine operation may be difficult without real-time calculation of the required unloader setting (or alternative unloader devices) in multiple stages and immediate feedback.

One or more embodiments provide for using a model with two modes to determine a real time flow rate of gas with one mode and an unloader setting or crank shaft speed ("shaft speed") based on a given flow rate with a second mode. In one or more embodiments, the second mode may be used to determine values for parameters of the compressor to have the compressor operate at a given flow rate. One or more embodiments provide for using the model during two stages of compressor operation—a high pressure stage and a low pressure stage—to optimize a speed and unloader setting for a given flow rate.

Figure 1:
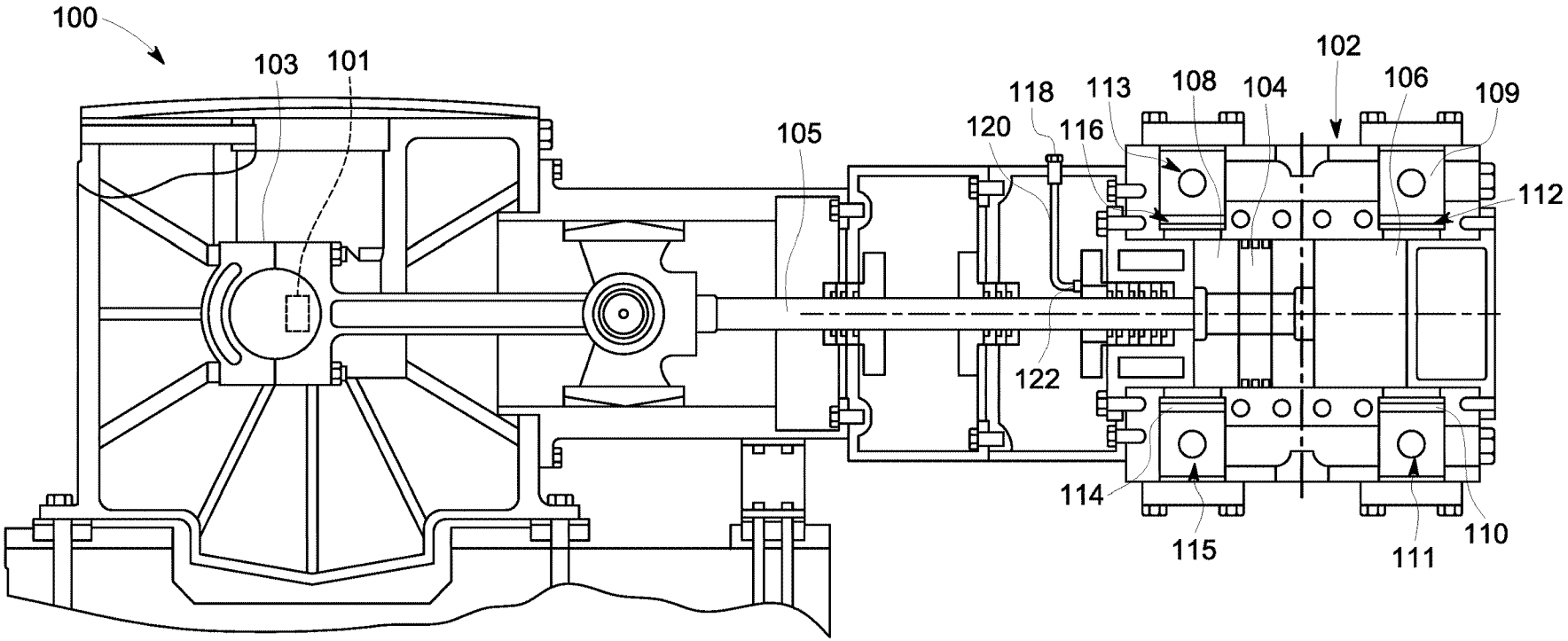
FIG. 1 illustrates a reciprocating compressor according to some embodiments.

FIG. 1 is a partial schematic view of an exemplary reciprocating compressor ("compressor") 100. The compressor 100 includes a cylinder 102 and a piston head 104 coupled to a piston rod 105. The piston rod 105 may be coupled to a crank shaft 101 ("shaft") housed in a crank case 103. The piston head 104 is positioned within the cylinder 102 and movable within the cylinder 102 in a reciprocating motion. The cylinder 102 includes a first end chamber 106 and an opposing second end chamber 108. A first end suction valve assembly 111 may include a first end suction valve 110 (e.g., a plate valve, a poppet valve). The first end suction valve 110 may be operatively coupled with respect to the first end chamber 106. The first end suction valve 110 opens to allow a gas or gas mixture to enter the first end chamber 106 as the piston head 104 move outwardly with respect to the first end chamber 106 during a suction stroke to draw the gas or gas mixture into the first end chamber 106. A first end discharge valve assembly 109 may include a first end discharge valve 112 (e.g., a plate valve, a poppet valve). The first end discharge valve assembly 109 may also be operatively coupled to the first end chamber 106. The first end discharge valve 112 opens to allow a compressed gas or gas mixture to exit the first end chamber 106 as the piston head 104 moves inwardly with respect to the first end chamber 106 during a compression stroke to force or direct the compressed gas or gas mixture out of the first end chamber 106. Similarly, a second end suction valve assembly 115 may include a second end suction valve 114 (e.g., plate valve, a poppet valve) may be operatively coupled with respect to the second end chamber 108. Second end suction valve 114 opens to allow the gas or gas mixture to enter the second end chamber 108 as the piston head 104 moves outwardly with respect to the second end chamber 108 to draw the gas or gas mixture into the second end chamber 108. A second end discharge valve assembly 113 may include a second end discharge valve 116 (e.g., a plate valve, a poppet valve). The second end discharge valve 116 may open to allow a compressed gas or gas mixture to exit the second end chamber 108 as the piston head 104 moves inwardly with respect to the second end chamber 108 to force or direct the compressed gas or gas mixture out of the second end chamber 108. In one or more embodiments, the position of the first and second end suction valve assemblies may be switched with the first and second end discharge valve assemblies.

In one or more embodiments, the valve timing may be related to the gas volumes exchanged during suction and discharge. As used herein, "valve timing" refers to the opening and closing of a valve. In one or more embodiments, the volume of gas that is exchanged may be based on at least one of cylinder geometry, shaft speed and position.

Clearance volume is a volume remaining in a chamber when a piston assembly (piston head and rod) is fully extended (sometimes expressed as a percentage of a swept volume). In one or more embodiments, manipulating the clearance volume or unloader setting by means of a first end chamber (e.g., head-end) cylinder and piston mechanism may perform the same function as an unloader valve or a bypass valve, as it may reduce the flow rate of the gas. In one or more embodiments, the unloader setting may affect the clearance volume, as the setting may adjust the amount of volume in the chamber. As used herein the terms "clearance volume" and "unloader setting" may be used interchangeably. Other suitable volume adjusters may be used (e.g., various types of valve unloaders, bypass valve loops, etc.). In one or more embodiments, the compressor 100 may be unloaded via a variable clearance pocket on a first end chamber of each cylinder, a valve opener that prevents or delays suction valves from closing, a plug unloader allowing valve backflow, a bypass valve or any other suitable compressor unloader.

In one or more embodiments, the pressure in the cylinder 102 during gas exchange (suction and discharge) may be related to a pressure drop over the suction valve(s) 110, 114 or discharge check valve(s) 112, 116. The pressure may drop over the check valves 110 and 114 due to the gas flow through check valve plate slots and the preload of the springs to close the valve plates.

Computational models are used to analyze data and generate results that may be used to make assessments and/or predictions of a physical system. An owner or operator of a system might want to monitor a condition of the system, or a portion of the system to help make maintenance decisions, budget predictions, etc.

Some embodiments relate to digital twin modeling. "Digital twin" state estimation modeling of industrial apparatus and/or other mechanically operational entities may estimate an optimal operating condition, remaining useful life, or other metric, of a twinned physical system using sensors, communications, modeling, history and computation. It may provide an answer in a time frame that is useful, that is, meaningfully priori to a projected occurrence of a failure event or suboptimal operation. The information may be provided by a "digital twin" of a twinned physical system. The digital twin may be a computer model that virtually represents the state of an installed product. The digital twin may include a code object with parameters and dimensions of its physical twin's parameters and dimensions that provide measured values, and keeps the values of those parameters and dimensions current by receiving and updating values via outputs from sensors embedded in the physical twin. The digital twin may have respective virtual components that correspond to essentially all physical and operational components of the installed product.

As used herein, references to a "digital twin" should be understood to represent one example of a number of different types of modeling that may be performed in accordance with teachings of this disclosure.

As used herein, the term "automatically" may refer to, for example, actions that may be performed with little or no human interaction.

Figure 2:
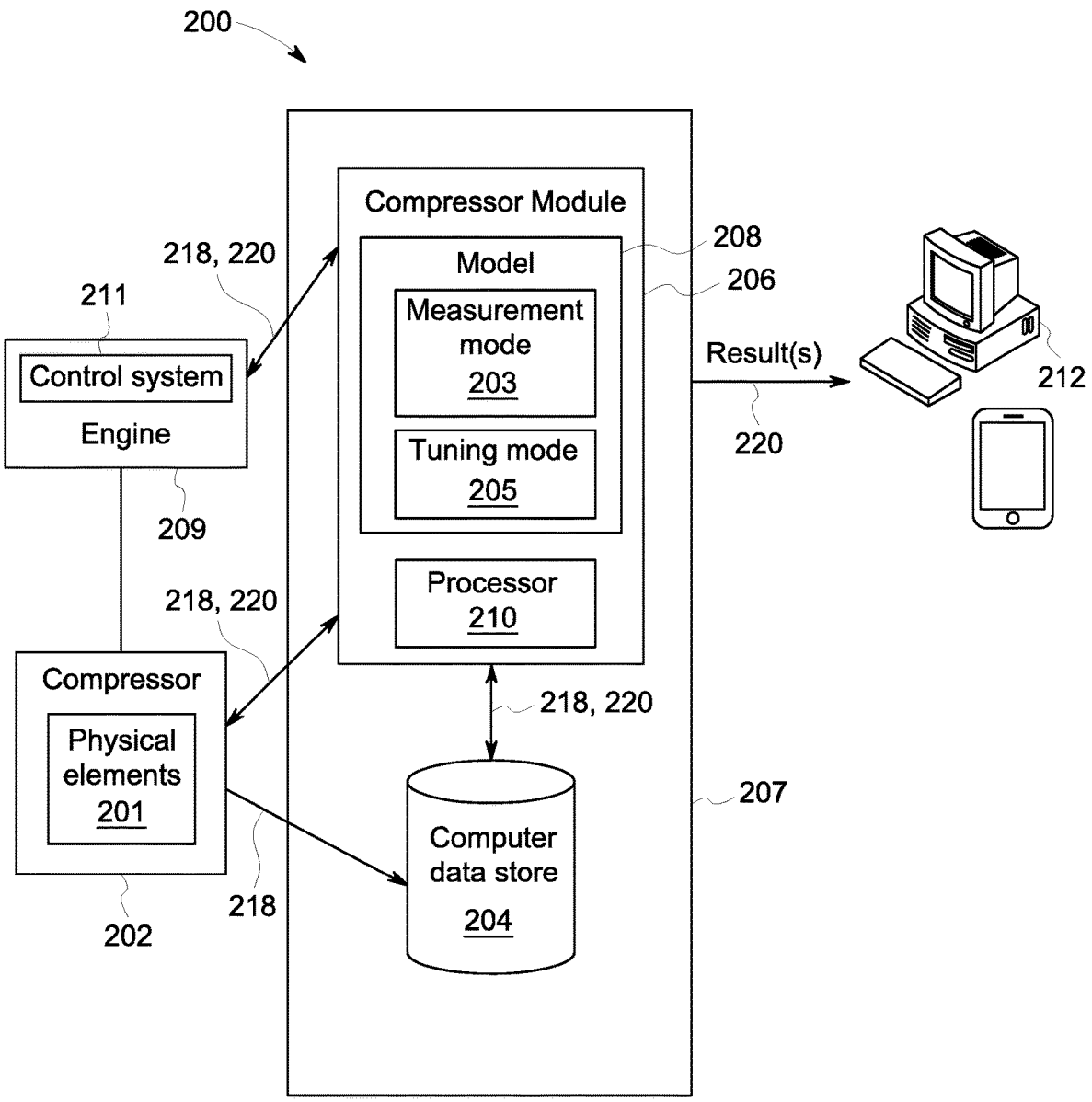
FIG. 2 illustrates a system according to some embodiments.

Turning to FIG. 2, a block diagram of a system 200 architecture is provided according to some embodiments. The system 200 may include a reciprocating compressor 202. The reciprocating compressor 202 may include one or more physical elements 201 (e.g., cylinder, piston, shaft, valves, etc.), as described above. In one or more embodiments, the compressor 202 may be operated by an engine 209 or motor. As used herein, the terms "motor" and "engine" may be used interchangeably. In one or more embodiments, an engine control system 211 may control operation of the engine 209. In one or more embodiments, the engine control system 211 may communicate with a compressor monitoring and control system module 206 ("compressor module"), as described further below.

The system 200 may include a platform 207. In some embodiments, the platform 207 may include a computer data store 204 that provides information to a compressor monitoring and control system module 206 and may store results from the compressor monitoring and control system module 206. The compressor monitoring and control system module 206 may include a dual-mode model 208 and one or more processing elements 210. The processor 210 may, for example, be a conventional microprocessor, and may operate to control the overall functioning of the compressor monitoring and control system module 206. In one or more embodiments, the dual-mode model 208 may at least one of receive data directly from the measurements at the reciprocating compressor 202 via a short term "buffer" memory and receive previously measured data from the data store 204.

In one or more embodiments, the dual-mode model 208 may allow operators of the compressor 202 to gauge a flow rate of the compressor 202 in real-time and/or to calculate one of a speed setting and unloader setting for the compressor 202 to operate the compressor at a desired flow rate. In one or more embodiments, the dual-mode model 208 may include valve pressure loss estimation, using valve area and spring load, as well as correlations stored in the model 208 for valve closure timing. In one or more embodiments, spring load may be an input to the dual-mode model 208 from a compressor valve specification.

In one or more embodiments, a first mode of the dual-mode model 208 is a measurement mode 203. In measurement mode 203, the model 208 may calculate an actual flow rate of the compressor 202 and the mechanical power used by physical elements 201 (e.g., each cylinder 102) in the compressor 202 based on current compressor operational data. In one or more embodiments, the current compressor operational data may include one or more measured inputs (e.g., suction pressure, suction temperature, discharge pressure and speed), cylinder geometry and gas properties.

In one or more embodiments, a second mode of the dual-mode model 208 is a tuning mode 205. In the tuning mode 205, for a desired flow rate, the model 208 may calculate one of an unloader setting and a speed. In one or more embodiments, execution of the tuning mode 205 of the model 208 may also determine whether the calculated unloader setting and speed exceeds compressor capacity. In one or more embodiments, unloader setting or speed may then either be set manually by the operator or automatically if the compressor and engine control systems are set up for fully automated operation and have an interface for remote inputs.

In one or more embodiments, the data store 204 may comprise any combination of one or more of a hard disk drive, RAM (random access memory), ROM (read only memory), flash memory, etc. The data store 204 may store software that programs the processor 210 and the compressor monitoring and control system module 206 to perform functionality as described herein.

The compressor monitoring and control system module 206, according to some embodiments, may access the data store 204 and utilize the dual-mode model 208 to create a predictive or analytic model that may be used to create a prediction and/or result that may be transmitted to at least one of various user platforms 212, back to the compressor 202 or to other systems (not shown), as appropriate (e.g., for display to a user, operation of the installed product, operation of another system, or input to another system).

The compressor monitoring and control system module 206 may be programmed with one or more software components that may model individual physical elements 201 that make up the compressor 202.

A communication channel 218 may be included in the system 200 to supply data from at least one of the compressor 202 and the data store 204 to the compressor monitoring and control system module 206.

In some embodiments, the system 200 may also include a communication channel 220 to supply output from the dual-mode model 208 in the compressor monitoring and control system module 206 to at least one of user platforms 212, back to the compressor 202, or to other systems. In some embodiments, signals received by the user platform 212, compressor 202 and other systems may cause modification in the state or condition or another attribute of one or more physical elements 201 of the compressor 202.

Although not separately shown in the drawing, one or more control units, processors, computers or the like may be included in the compressor 202 to control operation of the compressor 202, with or without input to the control units, etc., from the compressor monitoring and control system module 206.

As used herein, devices, including those associated with the system 200 and any other devices described herein, may exchange information via any communication network which may be one or more of a Local Area Network ("LAN"), a Metropolitan Area Network ("MAN"), a Wide Area Network ("WAN"), a proprietary network, a Public Switched Telephone Network ("PSTN"), a Wireless Application Protocol ("WAP") network, a Bluetooth network, a wireless LAN network, and/or an Internet Protocol ("IP") network such as the Internet, an intranet, or an extranet. Note that any devices described herein may communicate via one or more such communication networks.

A user may access the system 200 via one of the user platforms 212 (e.g., a personal computer, tablet, or smartphone) to view information about and/or manage the compressor 202 in accordance with any of the embodiments described herein. According to some embodiments, an interactive graphical display interface may let an operator define and/or adjust certain parameters and/or provide or receive automatically generated recommendations or results.

Figure 3:
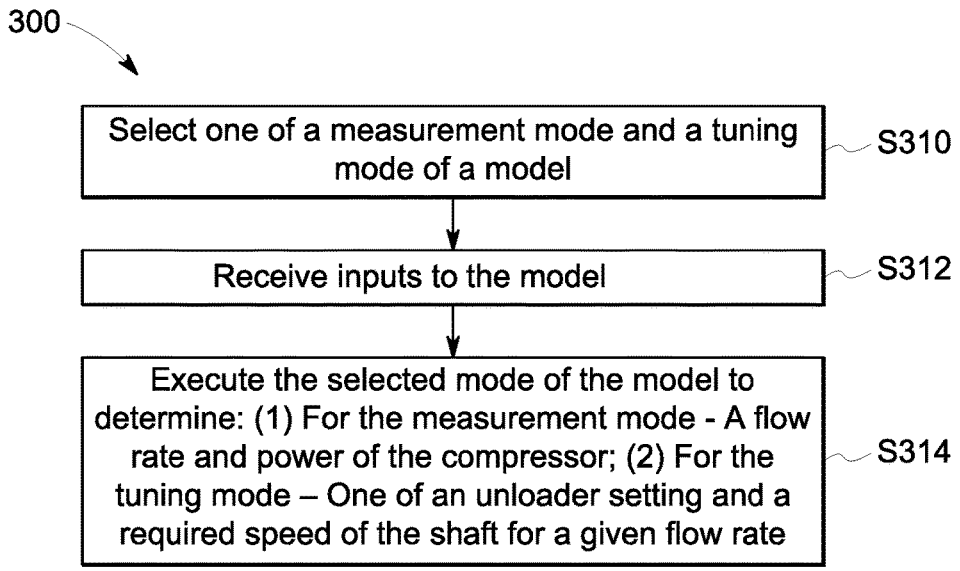
FIG. 3 illustrates a flow diagram according to some embodiments.

Turning to FIG. 3, a flow diagram of an example of operation according to some embodiments is provided. In particular, FIG. 3 provides a flow diagram of a process 300, according to some embodiments. Process 300, and other processes described herein (e.g., Process 800), may be performed using any suitable combination of hardware (e.g., circuit(s)), software or manual means. For example, a computer-readable storage medium may store thereon instructions that when executed by a machine result in performance according to any of the embodiments described herein. In one or more embodiments, the system 200 is conditioned to perform the process 300/800 such that the system is a special-purpose element configured to perform operations not performable by a general-purpose computer or device. Software embodying these processes may be stored by any non-transitory tangible medium including a fixed disk, a floppy disk, a CD, a DVD, a Flash drive, or a magnetic tape.

Examples of these processes will be described below with respect to embodiments of the system, but embodiments are not limited thereto. The flow chart(s) described herein do not imply a fixed order to the steps, and embodiments of the present invention may be practiced in any order that is practicable.

The inventor notes, no measured inputs are needed for the model 208 in measurement mode 203 other than suction pressure, suction temperature, discharge pressure and crank shaft speed. The inventor notes avoiding further measured inputs may be beneficial in that typically measurements require sensor/probes to acquire these measurements, and sensors/probes may be intrusive, prone to error, and may compromise mechanic integrity of the compressor. The inventor further notes that unlike conventional compressor control and diagnostic systems, in one or more embodiments, the model 208 is not based on "manufacturer's loading curves" but on the use of thermodynamic equations to compute pressures, valve timing, flow rate and power in real time, without reliance on statistical historic data.

Initially, in S310 a user (not shown) selects one of a measurement mode 203 and a tuning mode 205 of the model 208 to execute.

In one or more embodiments, any suitable user interface through which users may communicate with the compressor monitoring and control system module 206 (and model 208) executing on the platform 207 may be provided. For example, the interface may include a HyperText Transfer Protocol (HTTP) interface supporting a transient request/response protocol over Transmission Control Protocol/Internet Protocol (TCP/IP), a Web Socket interface supporting non-transient full-duplex communications which implement the Web Socket protocol over a single TCP/IP connection, and/or an Open Data Protocol (OData) interface. Presentation of a user interface as described herein may comprise any degree or type of rendering, depending on the type of user interface code generated by the platform 207.

For example, a user may execute a Web Browser to request and receive a Web page (e.g., in HTML format) from a website application via HTTP, HTTPS, and/or WebSocket, and may render and present the Web page according to known protocols. In one or more embodiments, the user interface may also be presented by executing a standalone executable file (e.g., an .exe file) or code (E.g., a JAVA applet) within a virtual machine.

Then in S312, the model 208 receives the inputs appropriate for the selected mode. In one or more embodiments, the compressor 202 operation input data of suction pressure, suction temperature, discharge pressure and speed (for the measurement mode) may be received from an installed compressor and engine control system via a digital input/output (I/O) interface, or via any other suitable source. In S314, the selected mode of the model is executed to determine (1) for the measurement mode 203, a flow rate of gas, and a power used by physical element 201 in the compressor 202; (2) for the tuning mode 205, one of an unloader setting and a required speed of the shaft for a given flow rate. In one or more embodiments, the model 208 may use algorithms, such as, but not limited to thermodynamic equations for compressibility-corrected ideal gas isentropic compression to describe the pressure-temperature-volume state. In one or more embodiments, the model 208 may be a thermodynamic model with detailed valve pressure loss estimation using valve area and spring load, as well as correlations for valve closure timing.

Figure 4:
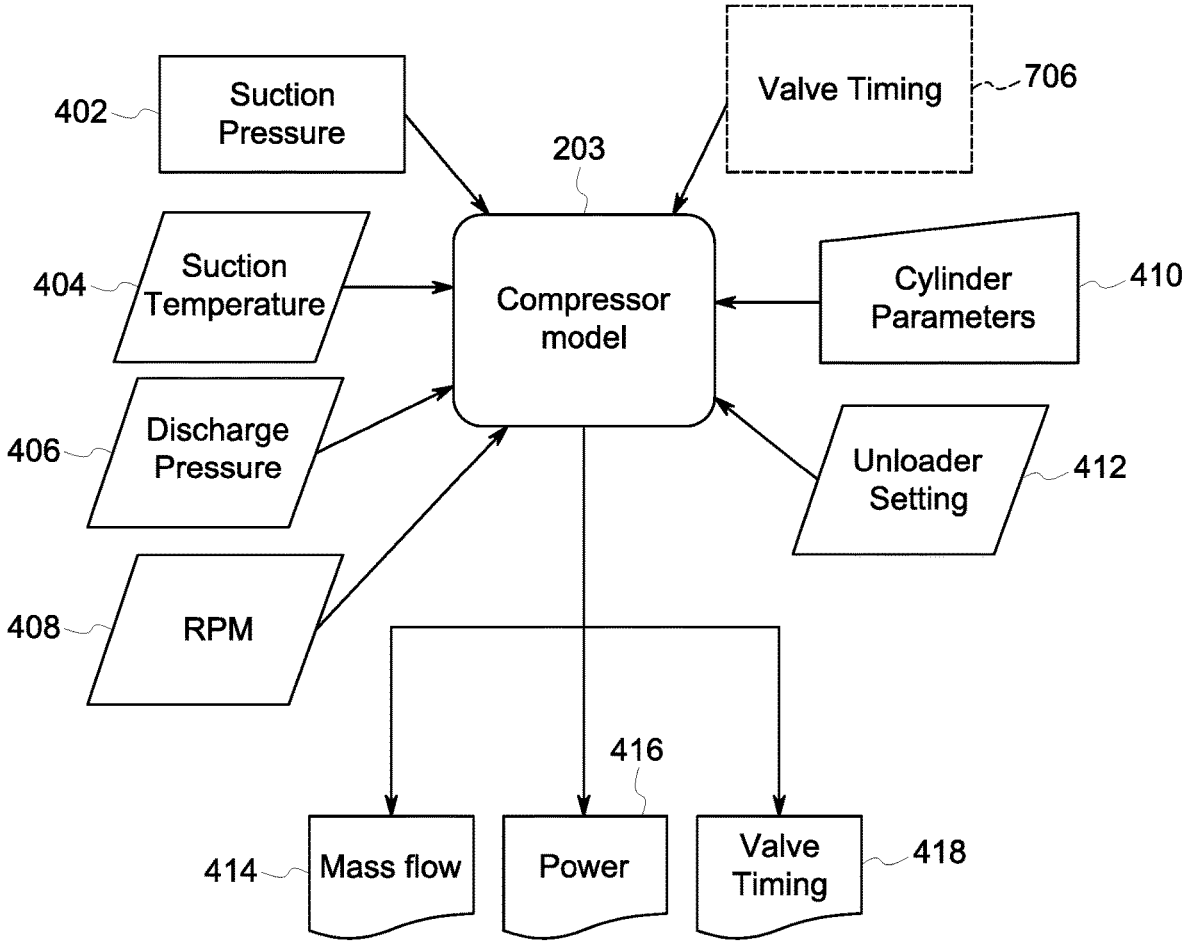
FIG. 4 illustrates a block diagram according to some embodiments.

Consider, for example, FIG. 4 which illustrates a measurement mode 203 of the model 208. The inputs to the measurement mode 203 may include suction pressure 402, suction temperature 404, discharge pressure 406 and a crank shaft speed 408 (measured in revolutions per minute (RPM)). In one or more embodiments, the calculations may be duplicated for each cylinder side in double acting compressors, and further instances may be set up for a second compression stage, as further described below with respect to FIG. 7.

In one or more embodiments, other inputs to the measurement mode 203 may include cylinder parameters 410 (e.g., geometry of the cylinder) and an unloader setting 412.

Execution of the measurement mode 203 of the model 208 may result in output including a mass flow rate 414 of the compressor 202, a power 416 used by the physical element 201 of the compressor 202, and a valve timing 418. In one or more embodiments, the measurement mode 203 may use empirical values for mechanical efficiencies to calculate the power 416. In one or more embodiments, the output of the measurement mode 203 may be at least one of displayed to operators via user platform 212, recorded and stored in data store 204 and transmitted remotely. In one or more embodiments, the determined mass flow rate 414 may be compared to a threshold value. In one or more embodiments, the threshold value may be an optimal or benchmark value. If the determined mass flow rate 414 deviates from the threshold value, a notification (e.g., alarm) may be activated. In one or more embodiments, the notification may indicate the amount of the deviation and may provide other information about the deviation.

Figure 5:
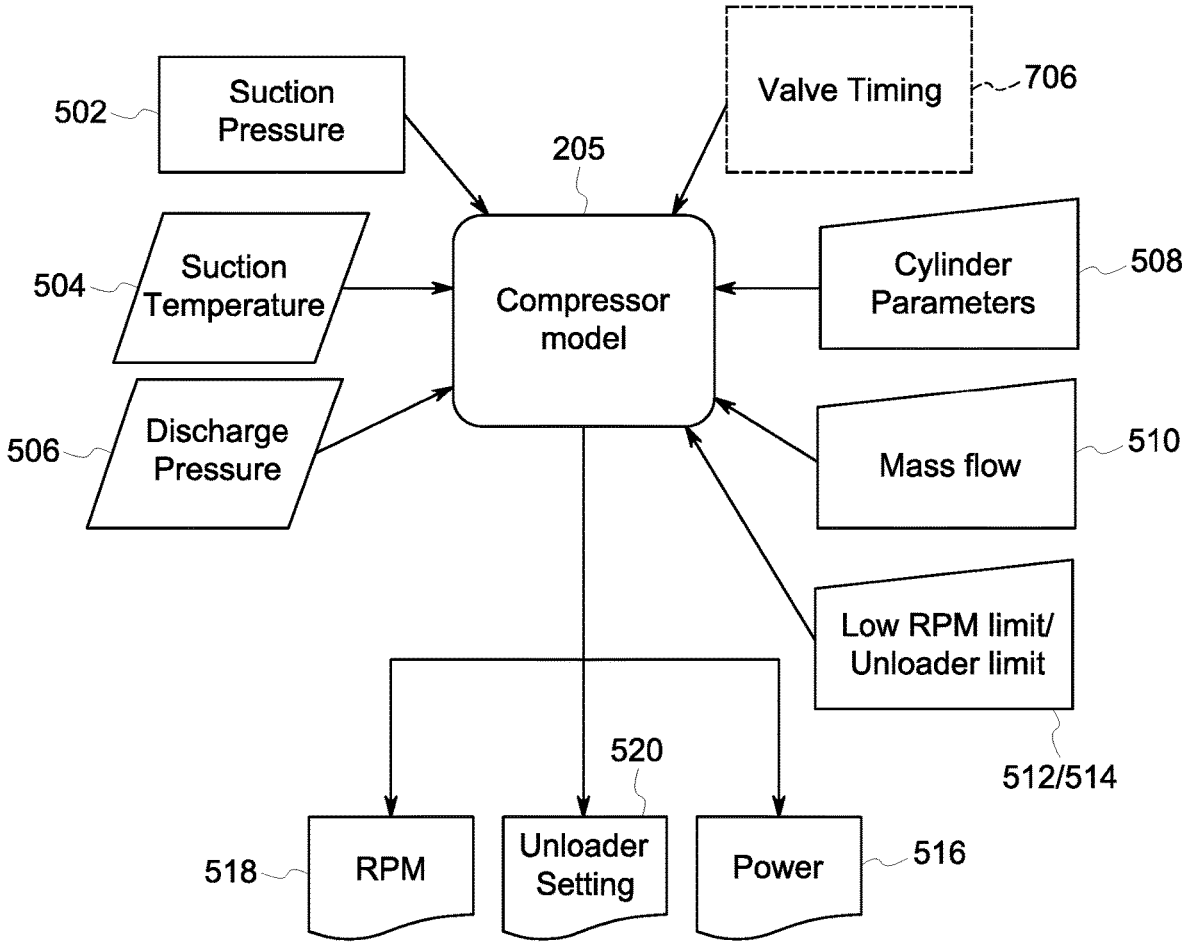
FIG. 5 illustrates a block diagram according to some embodiments.

Consider, for example, FIG. 5 which illustrates a tuning mode 205 of the model 208. The inputs to the tuning mode 205 may include a suction pressure 502, a suction temperature 504, a discharge pressure 506, and cylinder parameters 508, as described above with respect to the measurement mode 203. In one or more embodiments, another input to the tuning mode 205 is a desired or given flow rate 510. In one or more embodiments, another input is one of a shaft speed 512 or an unloader limit 514. In one or more embodiments, the shaft speed 512 may be input as a lower speed limit. As used herein, the terms "unloader setting/limit" and "clearance volume" may be used interchangeably.

Execution of the tuning mode 205 of the model 208 may result in output including a power 516 consumed by physical elements 201 of the compressor 202, and either a shaft speed 518 or a clearance volume/unloader setting 520. In one or more embodiments, the output of the tuning mode 205 may be displayed for an operator via user platform 212 for setting the value manually, or may be passed as an input signal directly to the compressor 202 for automatic adjustment. In one or more embodiments, unloader settings may be set manually by adjusting the shaft in the clearance pocket with a spindle and nut, while finger-type valve openers or recirculation valves may be automatically set.

In one or more embodiments, closed-loop flow control may be achieved by switching between the measurement mode 203 and the tuning mode 205, and using, for example, a control algorithm to change the speed or unloader setting to obtain a desired flow rate. In one non-exhaustive example, operating parameters (e.g., shaft speed, unloader setting) for a desired flow rate are determined via the tuning mode of the model. Then the parameters on the compressor are manipulated to match the output values from the tuning mode. The measurement mode may then be executed to determine if the flow rate meets the desired flow rate. If not, the operating parameters may be further manipulated and/or other settings may be determined, to eventually have the desired flow rate match the actual flow rate.

In one or more embodiments, the system 200 may run the tuning mode 205 of the model 208 in an iteration loop to determine either the required shaft speed 518 or the unloader setting 520 for a desired flow rate 510 and given suction pressure 502, suction temperature 504 and discharge pressure 506. In one or more embodiments, the iteration loop may be implemented in the system 200 by running/executing the model 208 repeatedly with iteratively changed input data until convergence of model-predicted and desired output data.

Figure 6:
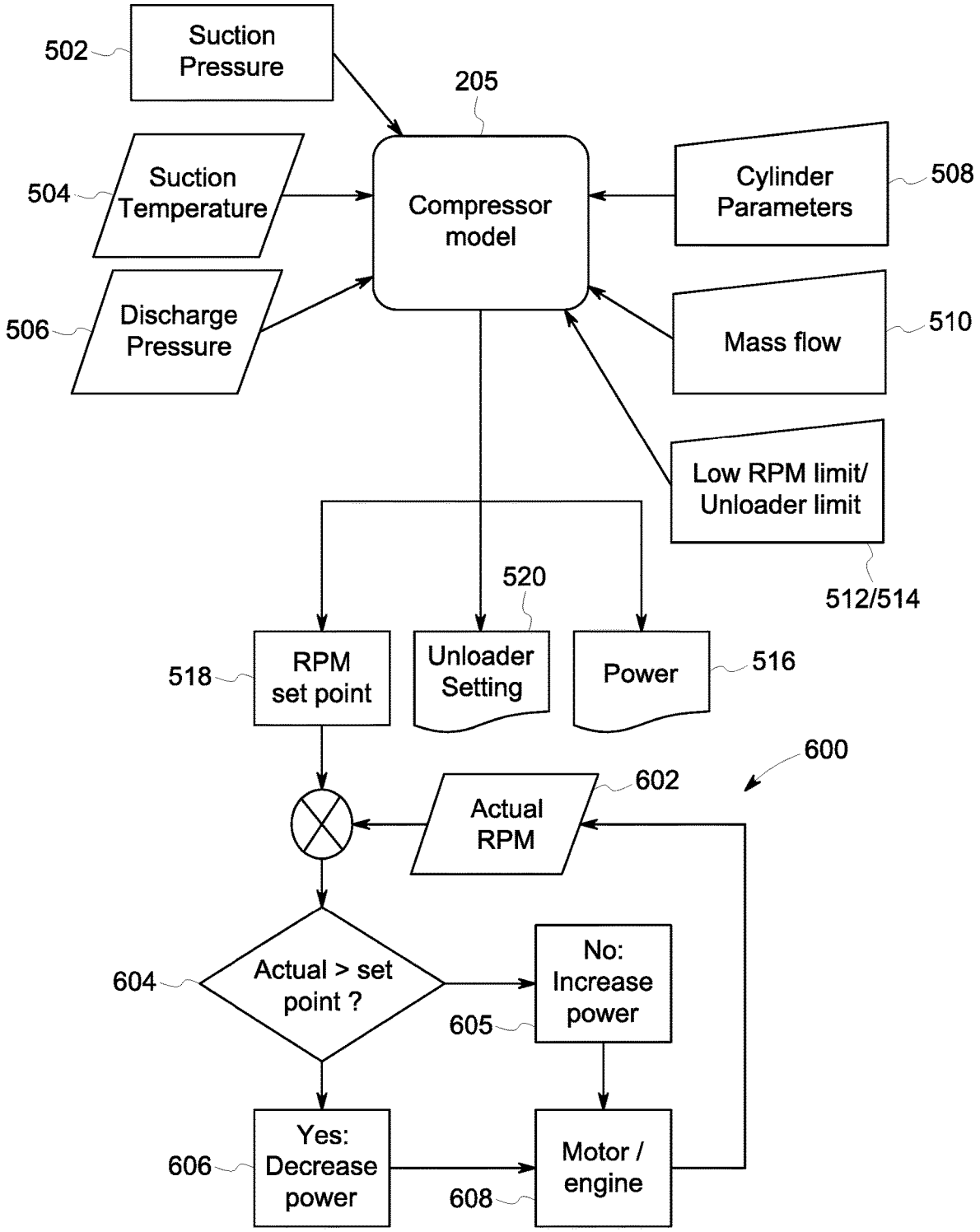
FIG. 6 illustrates a block diagram according to some embodiments.

In one or more embodiments, the tuning mode 205 of the model 208 may include a feedback speed control loop 600, as shown, for example, in the flow diagram in FIG. 6. As described above, with respect to FIG. 5, the power 516 consumed by the physical elements 201 of the compressor 202, and either the shaft speed 518 or the clearance volume/unloader setting 520 is determined. Then, in one or more embodiments, it is determined 604 whether the actual shaft speed in the operating compressor 202 is greater than the determined shaft speed 518 (e.g., RPM set point). If the actual speed 602 is greater than the determined shaft speed 518, the system 200 may decrease the power 606 to the motor/engine 608 associated with the compressor 202, and then the actual speed of the shaft 602 may be again determined. If the actual speed 602 is less than the determined shaft speed 518, the system 200 may increase the power 605 to the motor/engine 608 associated with the compressor 202, and then the actual speed of the shaft 602 may be again determined. In one or more embodiments this feedback speed control loop 600 may be repeated, with iterative changes to the power, until the actual speed 602 is equal to the RPM set point 518 (determined shaft speed).

Figure 7:
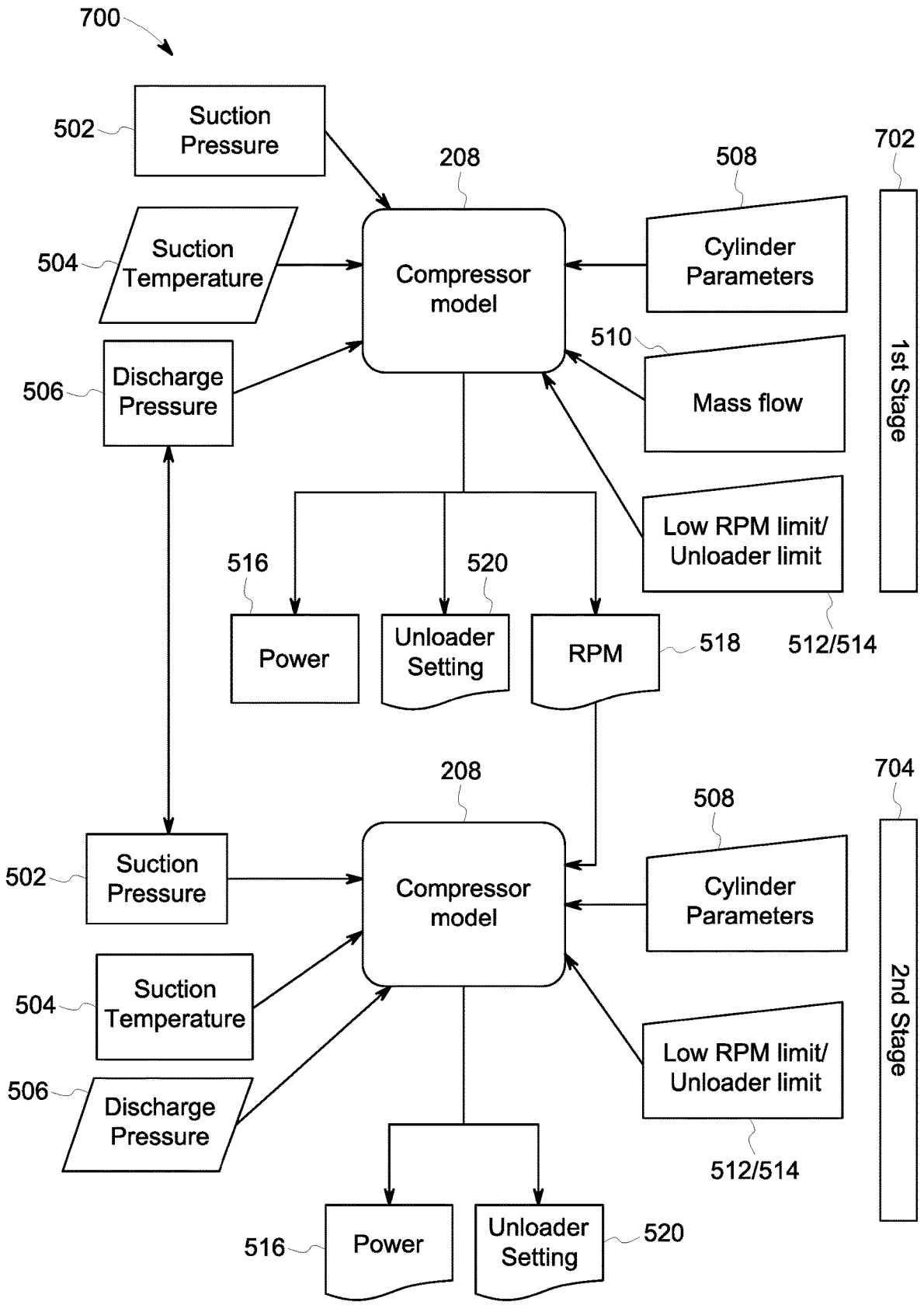
FIG. 7 illustrates a block diagram according to some embodiments.
Figure 8:
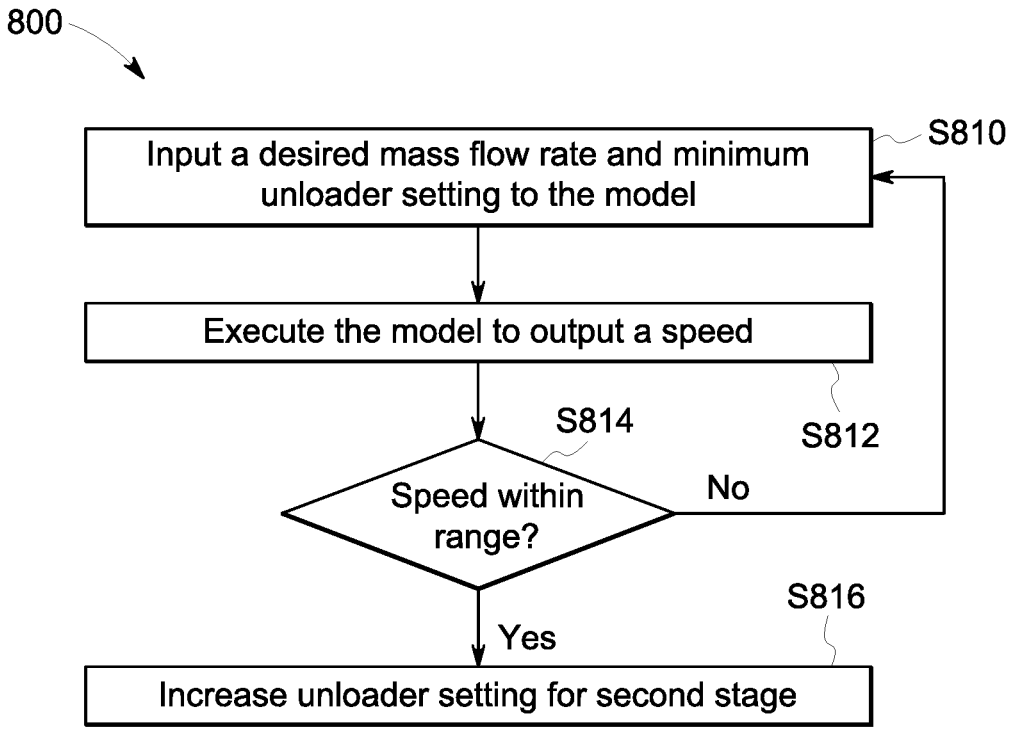
FIG. 8 illustrates a flow diagram according to some embodiments.

Consider, for example, FIG. 7, which illustrates a two-stage reciprocating compressor optimization model 700 and an associated flow diagram of a process 800 in FIG. 8.

In one or more embodiments, the compressor monitoring and control system module 206 may employ the model 208 to optimize the shaft speed and set the unloaders for a desired flow rate for at least two stages of compressor 202 operation. While the non-exhaustive examples described herein describe two stages, a high pressure stage and a low pressure stage, embodiments may be applied to situations having more than two stages. The inventor notes that optimization of an inter-stage pressure and minimization of an engine speed through adjustment of unloaders may result in through-put maximization (e.g., maximized flow rate) at the same time of load and emission minimization, which may result in an operating expense reduction.

In one or more embodiments, the model 208 may be executed one time for each stage. In one or more embodiments, the model 208 may be executed for each cylinder side in a double acting compressor.

As shown in FIG. 7, for a first stage 702, the tuning mode 205 of the model 208 is executed, as described above with respect to FIG. 5, and a speed 518 for a given flow rate and unloader setting is determined. For example, initially at S810, a desired mass flow rate, and a minimum unloader setting for both stages are provided as input to the model 208. The model 208 is executed, and outputs a speed to operate the shaft 103 at the given flow rate with the specified unloader setting in S812.

Then in S814 it is determined whether the output speed is within an appropriate operational range for the compressor 202 and the engine 209. If the output speed is not within the appropriate operational range, the process 800 returns to S810 and the inputs to the model 208 may be changed. For example, if a minimum speed of the engine operating the compressor 202 is greater than the output speed, the first stage unloader setting input may be increased. The minimum speed may be provided by the engine control system 211 or manufacturer specifications. As another example, if the output speed is greater than a maximum speed (e.g., specified by an operator or manufacturer specification) at which the compressor or the driving engine 209 may be operated, the desired mass flow rate input may be decreased or the unloader setting minimized. In one or more embodiments, mass flow rate, shaft speed, an inter-stage pressure and an inter-stage temperature may be coupled between the first stage 702 and the second stage 704, a discharge pressure of the first (e.g., low) pressure stage 702, for example, may be the suction pressure of the second (e.g., high) pressure stage 704.

Then, in one or more embodiments, the tuning mode 205 of the model 208 may be executed, as described above with respect to FIG. 5, for a second stage 704, and a power 516 and unloader setting 520 may be determined outputs.

If the output speed is within an appropriate operational range for the compressor 202 and the engine 209 in S814, the process 800 proceeds to S816 and the unloader setting for the second stage 704 may be either decreased to lower the inter-stage pressure if the pressure ratio of the second stage is less than an optimum or the inlet pressure becomes higher than a desired limit, or may be increased to raise the inter-stage pressure in case the second stage pressure ratio is larger than an optimum or the inlet pressure is lower than required to minimize the compressor power demand. The power demand is an output of the compressor model. In one or more embodiments, the minimum unloader setting associated with the second stage may be increased when the inter-stage pressure is lower than an optimum value that is desired for minimum power consumption and within limits specified by the operator or manufacturer. In one or more embodiments, the minimum unloader setting associated with the second stage may be increased when the minimum speed set point is greater than the minimum speed and less than the maximum speed to minimize power input to the compressor and maintain the second stage inlet pressure within specified limits. In one or more embodiments, this process may be repeated until the power is minimized while the pressure limits of both stages are adhered to.

In one or more embodiments, the parameters speed, first and second stage unloader setting and inter-stage pressure may be interchangeable between input and output for a given flow rate. For example, to reduce the flow rate, the shaft speed may be minimized first, then the first stage unloader setting increased. Then the second stage unloader setting may be adjusted to optimize the inter-stage pressure. Then the process may be iteratively repeated until the measured flow rate is the same as the desired flow rate.

In one or more embodiments, if multiple identical compressors are operated in parallel under the same conditions in a compressor station on a pipeline for instance, a number N of individual compressor units may be controlled in the same method as outlined above each until a desired total flow rate of all units becomes less than (N−1)/N times a maximum flow rate of all units. When the desired flow rate falls below this point, one unit may be switched off. Each of the compressors remaining in operation may be controlled again in the same method and the flow rate increased accordingly such that the total flow rate reaches the desired value. In this way the operational expense of the compressor station may be minimized as fewer individual compressors may be in operation and the efficiency of these compressors increases as their load is raised.

In one or more embodiments, the model 208 may be extended with one or more additional inputs. For example, another input may be valve timing measurements 706 (FIGS. 4 and 5) (e.g., the time relative to the revolution of the crank shaft if the valve opens or closes). As described above, valve timing is related to the gas volumes exchanged during suction and discharge, which may be described by the cylinder geometry, shaft speed and position. In one or more embodiments, the valve timing may be measured acoustically (e.g., via vibration sensors that give a noise signature of the valve opening and closing). The extended model 208 may improve flow metering accuracy since the valve opening and closing timing under real compressor operation may deviate from the ideal timing calculated by the model. The extended model may also detect valve timing deviations from ideal operation caused by broken valves. In one or more embodiments, the detected deviation may raise an alert or alarm notification for an operator.

Figure 9:
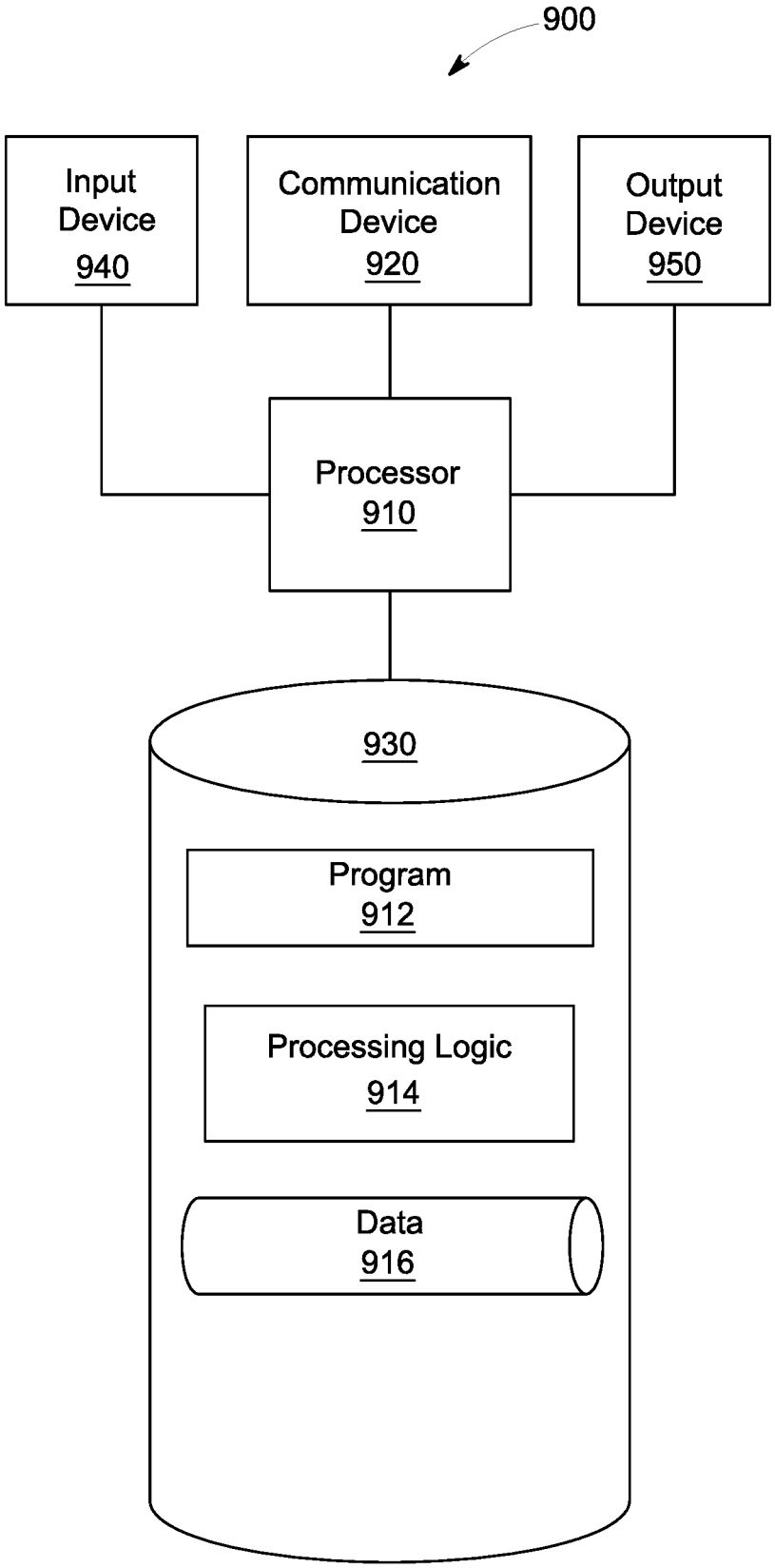
FIG. 9 illustrates a block diagram of a system according to some embodiments.

Note the embodiments described herein may be implemented using any number of different hardware configurations. For example, FIG. 9 illustrates a compressor model platform 900 that may be, for example, associated with the system 200 of FIG. 2. The compressor model platform 900 comprises a compressor model processor 910 ("processor"), such as one or more commercially available Central Processing Units (CPUs) in the form of one-chip microprocessors, coupled to a communication device 920 configured to communicate via a communication network (not shown in FIG. 9). The communication device 920 may be used to communicate, for example, with one or more users. The compressor model platform 900 further includes an input device 940 (e.g., a mouse and/or keyboard to enter information about the node of interest) and an output device 950 (e.g., to output and display the lineage).

The processor 910 also communicates with a memory/storage device 930. The storage device 930 may comprise any appropriate information storage device, including combinations of magnetic storage devices (e.g., a hard disk drive), optical storage devices, mobile telephones, and/or semiconductor memory devices. The storage device 930 may store a program 912 and/or model processing logic 914 for controlling the processor 910. The processor 910 performs instructions of the programs 712, 714, and thereby operates in accordance with any of the embodiments described herein. For example, the processor 910 may receive data and then may apply the instructions of the programs 912, 914 to determine a flow rate and/or parameters associated with a given flow rate.

The programs 912, 914 may be stored in a compressed, uncompiled and/or encrypted format. The programs 912, 914 may furthermore include other program elements, such as an operating system, a database management system, and/or device drivers used by the processor 910 to interface with peripheral devices.

As used herein, information may be "received" by or "transmitted" to, for example: (i) the platform 900 from another device; or (ii) a software application or module within the platform 900 from another software application, module, or any other source.

It is noted that while progress with industrial equipment automation has been made over the last several decades, and assets have become 'smarter,' the intelligence of any individual asset pales in comparison to intelligence that can be gained when multiple smart devices are connected together. Aggregating data collected from or about multiple assets may enable users to improve business processes, for example by improving effectiveness of asset maintenance or improving operational performance, if appropriate. Industrial-specific data collection and modeling technology may be developed and applied.

In an example, an industrial asset may be outfitted with one or more sensors configured to monitor respective ones of an asset's operations or conditions. Data from the one or more sensors may be recorded or transmitted to a cloud-based or other remote computing environment. By bringing such data into a cloud-based computing environment, new software applications informed by industrial process, tools and know-how may be constructed, and new physics-based analytics specific to an industrial environment may be created. Insights gained through analysis of such data may lead to enhanced asset designs, or to enhanced software algorithms for operating the same or similar asset at its edge, that is, at the extremes of its expected or available operating conditions.

The systems and methods for managing industrial assets may include or may be a portion of an Industrial Internet of Things (IIoT). In an example, an IIoT connects industrial assets, such as turbines, jet engines, and locomotives, to the Internet or cloud, or to each other in some meaningful way. The systems and methods described herein may include using a "cloud" or remote or distributed computing resource or service. The cloud may be used to receive, relay, transmit, store, analyze, or otherwise process information for or about one or more industrial assets. In an example, a cloud computing system may include at least one processor circuit, at least one database, and a plurality of users or assets that may be in data communication with the cloud computing system. The cloud computing system may further include, or may be coupled with, one or more other processor circuits or modules configured to perform a specific task, such as to perform tasks related to asset maintenance, analytics, data storage, security, or some other function.

However, the integration of industrial assets with the remote computing resources to enable the IIoT often presents technical challenges separate and distinct from the specific industry and from computer networks, generally. A given industrial asset may need to be configured with novel interfaces and communication protocols to send and receive data to and from distributed computing resources. Given industrial assets may have strict requirements for cost, weight, security, performance, signal interference, and the like, such that enabling such an interface is rarely as simple as combining the industrial asset with a general purpose computing device.

To address these problems and other problems resulting from the intersection of certain industrial fields and the IIoT, embodiments may enable improved interfaces, techniques, protocols, and algorithms for facilitating communication with, and configuration of, industrial assets via remote computing platforms and frameworks. Improvements in this regard may relate to both improvements that address particular challenges related to particular industrial assets (e.g., improved aircraft engines, wind turbines, locomotives, medical imaging equipment) that address particular problems related to use of these industrial assets with these remote computing platforms and frameworks, and also improvements that address challenges related to operation of the platform itself to provide improved mechanisms for configuration, analytics, and remote management of industrial assets.

The Predix™ platform available from GE is a novel embodiment of such Asset Management Platform (AMP) technology enabled by state of the art cutting edge tools and cloud computing techniques that may enable incorporation of a manufacturer's asset knowledge with a set of development tools and best practices that may enable asset users to bridge gaps between software and operations to enhance capabilities, foster innovation, and ultimately provide economic value. Through the use of such a system, a manufacturer of industrial assets can be uniquely situated to leverage its understanding of industrial assets themselves, models of such assets, and industrial operations or applications of such assets, to create new value for industrial customers through asset insights.

Figure 10:
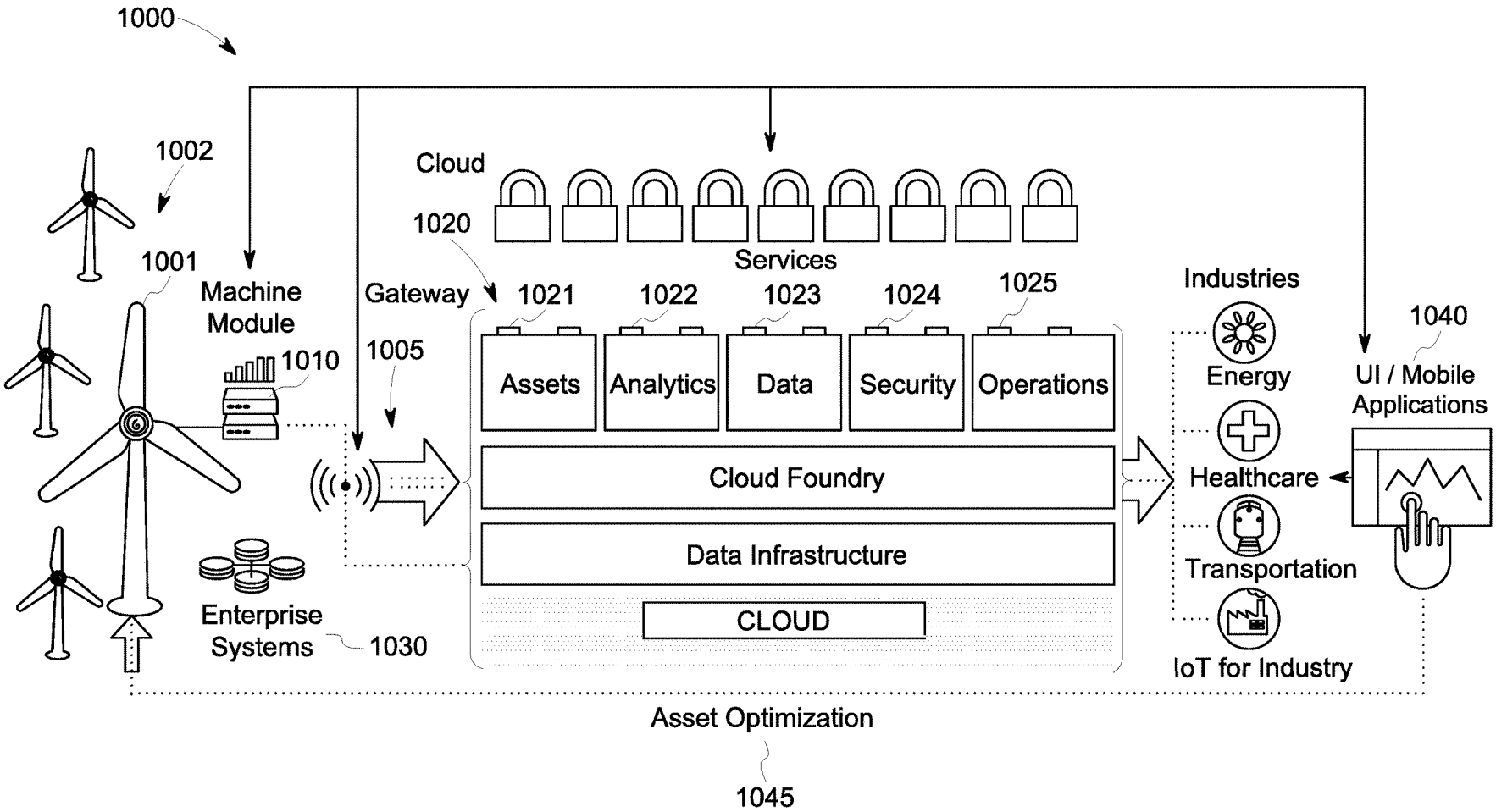
FIG. 10 illustrates a block diagram according to some embodiments.

FIG. 10 illustrates generally an example of portions of a first AMP 1000. As further described herein, one or more portions of an AMP may reside in an asset cloud computing system 1020, in a local or sandboxed environment, or may be distributed across multiple locations or devices. An AMP may be configured to perform any one or more of data acquisition, data analysis, or data exchange with local or remote assets, or with other task-specific processing devices.

The first AMP 1000 may include a first asset community 1002 that may be communicatively coupled with the asset cloud computing system 1020. In an example, a machine module 1010 receives information from, or senses information about, at least one asset member of the first asset community 1002, and configures the received information for exchange with the asset cloud computing system 1020. In an example, the machine module 1010 is coupled to the asset cloud computing system 1020 or to an enterprise computing system 1030 via a communication gateway 1005.

In an example, the communication gateway 1005 includes or uses a wired or wireless communication channel that may extend at least from the machine module 1010 to the asset cloud computing system 1020. The asset cloud computing system 1020 includes several layers. In an example, the asset cloud computing system 1020 includes at least a data infrastructure layer, a cloud foundry layer, and modules for providing various functions. In the example of FIG. 10, the asset cloud computing system 1020 includes an asset module 1021, an analytics module 1022, a data acquisition module 1023, a data security module 1024, and an operations module 1025. Each of the modules 1021-1025 includes or uses a dedicated circuit, or instructions for operating a general purpose processor circuit, to perform the respective functions. In an example, the modules 1021-1025 are communicatively coupled in the asset cloud computing system 1020 such that information from one module may be shared with another. In an example, the modules 1021-1025 are co-located at a designated datacenter or other facility, or the modules 1021-1025 can be distributed across multiple different locations.

An interface device 1040 may be configured for data communication with one or more of the machine module 1010, the gateway 1005, or the asset cloud computing system 1020. The interface device 1040 may be used to monitor or control one or more assets. In an example, information about the first asset community 1002 is presented to an operator at the interface device 1040. The information about the first asset community 1002 may include information from the machine module 1010, or the information may include information from the asset cloud computing system 1020. In an example, the information from the asset cloud computing system 1020 may include information about the first asset community 1002 in the context of multiple other similar or dissimilar assets, and the interface device 1040 may include options for optimizing one or more members of the first asset community 1002 based on analytics performed at the asset cloud computing system 1020.

In an example, an operator selects a parameter update for the first wind turbine 1001 using the interface device 1040, and the parameter update is pushed to the first wind turbine via one or more of the asset cloud computing system 1020, the gateway 1005, and the machine module 1010. In an example, the interface device 1040 is in data communication with the enterprise computing system 1030 and the interface device 1040 provides an operation with enterprise-wide data about the first asset community 1002 in the context of other business or process data. For example, choices with respect to asset optimization 1045 may be presented to an operator in the context of available or forecasted raw material supplies or fuel costs. In an example, choices with respect to asset optimization 1045 may be presented to an operator in the context of a process flow to identify how efficiency gains or losses at one asset may impact other assets. In an example, one or more choices described herein as being presented to a user or operator may alternatively be made automatically by a processor circuit according to earlier-specified or programmed operational parameters. In an example, the processor circuit may be located at one or more of the interface device 1040, the asset cloud computing system 1020, the enterprise computing system 1030, or elsewhere.

Returning again to the example of FIG. 10 some capabilities of the first AMP 1000 are illustrated. The example of FIG. 10 includes the first asset community 1002 with multiple wind turbine assets, including the first wind turbine 1001. Wind turbines are used in some examples herein as non-limiting examples of a type of industrial asset that can be a part of, or in data communication with, the first AMP 1000.

In an example, the multiple turbine members of the asset community 1002 include assets from different manufacturers or vintages. The multiple turbine members of the asset community 1002 may belong to one or more different asset communities, and the asset communities may be located locally or remotely from one another. For example, the members of the asset community 1002 may be co-located on a single wind farm, or the members may be geographically distributed across multiple different farms. In an example, the multiple turbine members of the asset community 1002 may be in use (or non-use) under similar or dissimilar environmental conditions, or may have one or more other common or distinguishing characteristics.

FIG. 10 further includes the device gateway 1005 configured to couple the first asset community 1002 to the asset cloud computing system 1020. The device gateway 1005 may further couple the asset cloud computing system 1020 to one or more other assets or asset communities, to the enterprise computing system 1030, or to one or more other devices. The first AMP 1000 thus represents a scalable industrial solution that extends from a physical or virtual asset (e.g., the first wind turbine 1001) to a remote asset cloud computing system 1020. The asset cloud computing system 1020 optionally includes a local, system, enterprise, or global computing infrastructure that can be optimized for industrial data workloads, secure data communication, and compliance with regulatory requirements.

In an example, information from an asset, about the asset, or sensed by an asset itself is communicated from the asset to the data acquisition module 1024 in the asset cloud computing system 1020. In an example, an external sensor may be used to sense information about a function of an asset, or to sense information about an environment condition at or near an asset. The external sensor may be configured for data communication with the device gateway 1005 and the data acquisition module 1024, and the asset cloud computing system 1020 may be configured to use the sensor information in its analysis of one or more assets, such as using the analytics module 1022.

In an example, the first AMP 1000 may use the asset cloud computing system 1020 to retrieve an operational model for the first wind turbine 1001, such as using the asset module 1021. The model may be stored locally in the asset cloud computing system 1020, or the model may be stored at the enterprise computing system 1030, or the model may be stored elsewhere. The asset cloud computing system 1020 may use the analytics module 1022 to apply information received about the first wind turbine 1001 or its operating conditions (e.g., received via the device gateway 1005) to or with the retrieved operational model. Using a result from the analytics module 1022, the operational model may optionally be updated, such as for subsequent use in optimizing the first wind turbine 1001 or one or more other assets, such as one or more assets in the same or different asset community. For example, information about the first wind turbine 1001 may be analyzed at the asset cloud computing system 1020 to inform selection of an operating parameter for a remotely located second wind turbine that belongs to a different second asset community.

The first AMP 1000 includes a machine module 1010. The machine module 1010 may include a software layer configured for communication with one or more industrial assets and the asset cloud computing system 1020. In an example, the machine module 1010 may be configured to run an application locally at an asset, such as at the first wind turbine 1001. The machine module 1010 may be configured for use with, or installed on, gateways, industrial controllers, sensors, and other components. In an example, the machine module 1010 includes a hardware circuit with a processor that is configured to execute software instructions to receive information about an asset, optionally process or apply the received information, and then selectively transmit the same or different information to the asset cloud computing system 1020.

In an example, the asset cloud computing system 1020 may include the operations module 1025. The operations module 1025 may include services that developers may use to build or test Industrial Internet applications, or the operations module 1025 may include services to implement Industrial Internet applications, such as in coordination with one or more other AMP modules. In an example, the operations module 1025 includes a micro-services marketplace where developers may publish their services and/or retrieve services from third parties. The operations module 1025 can include a development framework for communicating with various available services or modules. The development framework may offer developers a consistent look and feel and a contextual user experience in web or mobile applications.

In an example, an AMP may further include a connectivity module. The connectivity module may optionally be used where a direct connection to the cloud is unavailable. For example, a connectivity module may be used to enable data communication between one or more assets and the cloud using a virtual network of wired (e.g., fixed-line electrical, optical, or other) or wireless (e.g., cellular, satellite, or other) communication channels. In an example, a connectivity module forms at least a portion of the gateway 1005 between the machine module 1010 and the asset cloud computing system 1020.

In an example, an AMP may be configured to aid in optimizing operations or preparing or executing predictive maintenance for industrial assets. An AMP may leverage multiple platform components to predict problem conditions and conduct preventative maintenance, thereby reducing unplanned downtimes. In an example, the machine module 1010 is configured to receive or monitor data collected from one or more asset sensors and, using physics-based analytics (e.g., finite element analysis or some other technique selected in accordance with the asset being analyzed), detect error conditions based on a model of the corresponding asset. In an example, a processor circuit applies analytics or algorithms at the machine module 1010 or at the asset cloud computing system 1020.

In response to the detected error conditions, the AMP may issue various mitigating commands to the asset, such as via the machine module 1010, for manual or automatic implementation at the asset. In an example, the AMP may provide a shut-down command to the asset in response to a detected error condition. Shutting down an asset before an error condition becomes fatal may help to mitigate potential losses or to reduce damage to the asset or its surroundings. In addition to such an edge-level application, the machine module 1010 may communicate asset information to the asset cloud computing system 1020.

In an example, the asset cloud computing system 1020 may store or retrieve operational data for multiple similar assets. Over time, data scientists or machine learning may identify patterns and, based on the patterns, may create improved physics-based analytical models for identifying or mitigating issues at a particular asset or asset type. The improved analytics may be pushed back to all or a subset of the assets, such as via multiple respective machine modules 1010, to effectively and efficiently improve performance of designated (e.g., similarly-situated) assets.

In an example, the asset cloud computing system 1020 includes a Software-Defined Infrastructure (SDI) that serves as an abstraction layer above any specified hardware, such as to enable a data center to evolve over time with minimal disruption to overlying applications. The SDI enables a shared infrastructure with policy-based provisioning to facilitate dynamic automation, and enables SLA mappings to underlying infrastructure. This configuration may be useful when an application requires an underlying hardware configuration. The provisioning management and pooling of resources may be done at a granular level, thus allowing optimal resource allocation.

In a further example, the asset cloud computing system 1020 is based on Cloud Foundry (CF), an open source PaaS that supports multiple developer frameworks and an ecosystem of application services. Cloud Foundry can make it faster and easier for application developers to build, test, deploy, and scale applications. Developers thus gain access to the vibrant CF ecosystem and an ever-growing library of CF services. Additionally, because it is open source, CF can be customized for IIoT workloads.

The asset cloud computing system 1020 may include a data services module that may facilitate application development. For example, the data services module may enable developers to bring data into the asset cloud computing system 1020 and to make such data available for various applications, such as applications that execute at the cloud, at a machine module, or at an asset or other location. In an example, the data services module may be configured to cleanse, merge, or map data before ultimately storing it in an appropriate data store, for example, at the asset cloud computing system 1020. A special emphasis has been placed on time series data, as it is the data format that most sensors use.

Security may be a concern for data services that deal in data exchange between the asset cloud computing system 1020 and one or more assets or other components. Some options for securing data transmissions include using Virtual Private Networks (VPN) or an SSL/TLS model. In an example, the first AMP 1000 may support two-way TLS, such as between a machine module and the security module 1024. In an example, two-way TLS may not be supported, and the security module 1024 may treat client devices as OAuth users. For example, the security module 1024 may allow enrollment of an asset (or other device) as an OAuth client and transparently use OAuth access tokens to send data to protected endpoints.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It should be noted that any of the methods described herein can include an additional step of providing a system comprising distinct software modules embodied on a computer readable storage medium; the modules can include, for example, any or all of the elements depicted in the block diagrams and/or described herein. The method steps can then be carried out using the distinct software modules and/or sub-modules of the system, as described above, executing on one or more hardware processors 910 (FIG. 9). Further, a computer program product can include a computer-readable storage medium with code adapted to be implemented to carry out one or more method steps described herein, including the provision of the system with the distinct software modules.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application.

Those in the art will appreciate that various adaptations and modifications of the above-described embodiments can be configured without departing from the scope and spirit of the claims. Therefore, it is to be understood that the claims may be practiced other than as specifically described herein.

The invention claimed is:

1. A method comprising:

operating a reciprocating compressor with a control system having a dual-mode model having a measurement mode and a tuning mode, wherein operating comprises:

receiving one or more inputs into the dual-mode model measured from the reciprocating compressor during operation thereof; and in response to receipt of the one or more inputs, executing the dual-mode model in at least one of the measurement mode and the tuning mode, wherein:

in the measurement mode, execution of the dual-mode model further comprises calculating an actual flow rate of gas in the reciprocating compressor based on the one or more inputs; in the tuning mode, execution of the dual-mode model further comprises calculating one of an unloader setting and a speed set point of a physical element of the reciprocating compressor for a desired flow rate of gas, wherein the reciprocating compressor is a two-stage reciprocating compressor, including a first stage for lower pressure and a second stage for higher pressure;

setting a flow rate of gas and a minimum unloader setting for each of the first stage and the second stage;

calculating a shaft speed set point via application of the tuning mode of the dual-mode model for the set flow rate;

determining if the speed set point is greater than a minimum speed and less than a maximum speed;

increasing the minimum unloader setting associated with the first stage when the minimum speed is greater than the speed set point;

decreasing the set flow rate of gas when the speed set point is greater than the maximum speed; and increasing the minimum unloader setting associated with the second stage when an inter-stage pressure is lower than an optimum value.

2. The method of claim 1, further comprising:

in the tuning mode, one of receiving the unloader setting to calculate the speed of the physical element, wherein the physical element is a shaft, and receiving the speed of a shaft to calculate the unloader setting.

3. The method of claim 1, further comprising:

calculating a mechanical power used by each cylinder in the reciprocating compressor.

4. The method of claim 1, further comprising:

setting one of the unloader setting and the speed of a shaft based on the calculation in the tuning mode, wherein the setting is performed one of manually or automatically.

5. The method of claim 1, wherein, in the tuning mode, execution of the dual mode comprises calculating the speed set point and the unloader setting for each of the first and second stages to adjust the inter-stage pressure between the first stage and the second stage.

6. The method of claim 1, wherein the one or more inputs comprise a suction pressure, a suction temperature, and a discharge pressure.

7. A non-transitory, computer-readable medium storing instructions that, when executed by a computer processor, cause the computer processor to perform a method comprising:

operating a reciprocating compressor with a control system having a dual-mode model having a measurement mode and a tuning mode, wherein operating comprises:

receiving one or more inputs into the dual-mode model measured from the reciprocating compressor during operation thereof; and in response to receipt of the one or more inputs, executing, via the control system, the dual-mode model in at least one of the measurement mode and the tuning mode, wherein:

in the measurement mode, execution of the dual-mode model further comprises calculating an actual flow rate of gas in the reciprocating compressor based on the one or more inputs and via valve pressure loss estimation based on a valve area and spring load, wherein the actual flow rate of gas is calculated by using a thermodynamic model applying thermodynamic equations for compressibility-corrected ideal gas isentropic compression to describe the pressure-temperature-volume state; and in the tuning mode, execution of the dual-mode model further comprises calculating one of an unloader setting and a speed set point of a physical element of the reciprocating compressor for a desired flow rate of gas.

8. The medium of claim 7, wherein, in the measurement mode, execution of the dual-mode model comprises calculating the actual flow rate of gas based on the one or more inputs comprising temperature and pressure measurements of the gas flow through the reciprocating compressor.

9. The medium of claim 7, wherein, in the tuning mode, execution of the dual-mode model comprises calculating both the unloader setting and the speed set point of the physical element of the reciprocating compressor for the desired flow rate of gas.

10. The medium of claim 7, wherein, in the tuning mode, execution of the dual-mode model comprises calculating the unloader setting for first and second stages of the reciprocating compressor for the desired flow rate of gas.

11. The medium of claim 10, wherein, in the tuning mode, execution of the dual-mode model comprises calculating the unloader setting for the first and second stages to adjust an inter-stage pressure between the first and second stages of the reciprocating compressor.

12. The medium of claim 10, wherein, in the tuning mode, execution of the dual-mode model comprises calculating the unloader setting for the first stage prior to calculating the unloader setting for the second stage.

13. The medium of claim 10, wherein the unloader setting is different for the first and second stages of the reciprocating compressor for the desired flow rate of gas.

14. The medium of claim 10, wherein the control system is configured to repeatedly execute the measurement mode and the tuning mode until the actual flow rate is substantially the same as the desired flow rate of gas.

* * * * *